US006164923A

United States Patent [19]

Mayer et al.

[11] Patent Number: 6,164,923

[45] Date of Patent: Dec. 26, 2000

[54] MOBILE THICK MATTER PUMP

[75] Inventors: Martin Mayer, Beilstein; Willi Ebinger, Steinenbronn, both of Germany

[73] Assignee: Putzmeister Aktiengesellschaft, Germany

[21] Appl. No.: 09/230,146

[22] PCT Filed: Jul. 2, 1997

[86] PCT No.: PCT/EP97/03457

§ 371 Date: Jan. 19, 1999

§ 102(e) Date: Jan. 19, 1999

[87] PCT Pub. No.: WO98/09076

PCT Pub. Date: Mar. 5, 1998

[30] Foreign Application Priority Data

Aug. 30, 1996 [DE] Germany ..... 196 35 200

[51] Int. Cl.[7] ..... F04B 49/00

[52] U.S. Cl. ..... 417/212

[58] Field of Search ..... 417/212, 234, 417/500, 342, 339, 364, 15; 92/140

[56] References Cited

U.S. PATENT DOCUMENTS

| | | | |
|---|---|---|---|
| 5,535,780 | 7/1996 | Schlecht et al. | 137/615 |
| 5,640,996 | 6/1997 | Schlecht et al. | 137/615 |
| 5,967,756 | 10/1999 | Devier et al. | 417/18 |

FOREIGN PATENT DOCUMENTS

| | | | |
|---|---|---|---|
| 26 55 582 C2 | 6/1978 | Germany | F04B 15/02 |
| 35 07 963 A1 | 9/1985 | Germany | B60K 41/16 |
| 44 07 282 A1 | 9/1994 | Germany | F16H 61/40 |
| 1045506 | 10/1966 | United Kingdom . | |
| 2 137 572 | 10/1984 | United Kingdom | B60K 25/06 |

*Primary Examiner*—Teresa Walberg
*Assistant Examiner*—Vinod D Patel
*Attorney, Agent, or Firm*—Pendorf & Cutliff

[57] ABSTRACT

The invention relates to a travelling thick matter pump with a driving mechanism presenting an automobile engine (40) and a gear boxy (42), wherein the driven shaft (46) of the gear boxy can be connected via an interposable transfer gear (48) to a hydraulic pump (54) in order to drive the which matter pump (24) and a speed limitation device for the setting of a maximum engine speed during operation of the pump. I order to selectively ensure optimum pump operation, according to the invention the transfer gear (48) presents at least two step-up ratios after whose activation differing maximum engine speeds can be set via the speed limitation device (70).

9 Claims, 2 Drawing Sheets

MOBILE THICK MATTER PUMP

BACKGROUND OF THE INVENTION

1. Field of the Invention

The invention is related to a mobile thick matter pump having a drive mechanism comprising a vehicle motor and a gear box, at least one hydraulic pump for driving the thick matter pump, which pump is adapted to be coupled to a driven shaft of the gear box, if need be under interposition of a transfer gear box, as well as a speed limiter device for setting a maximum motor speed during the operation of the pump.

2. Description of the Related Art

For mobile concrete pumps it is known to use the existing motor and gear box of the vehicle to drive the hydraulic pumps. To this end, a transfer gear box is usually disposed in the drive train of the vehicle, which can be alternatively switched from a driving operation to a pumping operation. During the driving operation the driven shaft of the gear box is connected to the axle drive shafts of the vehicle by way of a direct drive of the gear box, while during the pumping operation it is switched to the hydraulic pumps. In the latter case the ratio of the gear box is chosen such that the maximum allowable pump speed is attained with the gear ratio of the gear box being a direct ratio (i=1) and approximately nominal speed of the motor. In many vehicle gear boxes the direct ratio is at the same time the highest speed ratio of the gear box and therefore corresponds to the highest gear. In principle it is possible to also pump using a lower gear. When limiting the maximum motor speed in the direct ratio to the nominal speed of the motor the maximum speed of the hydraulic pump and therefore the maximum pump capacity is not attained, though. Some vehicle gear boxes also have a speed increasing ratio (overdrive—i<1), in which the speed at the gear box output is higher than the motor speed. This is often realized by an intermediate gear or an additional gear of the gear box and serves as an economy or overdrive gear at high vehicle speeds.

During the operation of the known concrete pumps it is regarded to be disadvantageous that the speed setting in the region of the efficient nominal speed is accompanied by high noise levels and fuel comsumption.

SUMMARY OF THE INVENTION

Based on this it is the object of the invention to improve the known mobile thick matter pump such that for a given pump speed the noise emission and fuel consumption of the vehicle motor may be reduced.

The solution according to the invention is based on the idea that the gear box has at least two gear ratios, at the selection of which different maximum motor speeds are set by way of the speed limiter device. In this it is especially advantageous when depending on the chosen ratio a different maximum motor speed is allocated to two specific gear ratios, these being a direct ratio and a speed increasing ratio (overdrive). When in this case the efficient nominal speed of the motor is set to be the maximum motor speed for the direct ratio, it is expedient to reduce the maximum motor speed when switching to the speed increasing ratio, the ratio in the intermediate gear being constant, so as not to excced the maximum allowable pump speed. This makes it possible to use the optimum pump speed with a reduced motor speed and therefore less noise and fuel consumption. This is the case when the maximum motor speeds allocated to the different gear ratios are essentially proportional to their ratio.

The maximum motor speeds can be set either by mechanical or by electronic means. In the former case the speed limiter device expediently comprises an adjustable mechanical limit stop at an adjusting mechanism for controlling the fuel delivery to the vehicle motor, while in the latter case the speed limiter device may comprise a micro processor circuit for limiting the motor speed in dependence of the chosen gear ratio.

An especially simple operation is ensured when a sensor for controlling the speed limiter device, which sensor responds to a gear selector position of the gear box, is provided.

A further improvement in this respect is attained when a switching device for remote controlling the gear box and for correspondingly controlling the speed limiter device, which switching device responds to remote control signals, is provided. Instead of or complementary to the remote control it is also possible to provide a switching device for automatically changing the gear ratios and the corresponding maximum motor speed, which switching device responds to falling below or exceeding a preset pump pressure or a preset minimum motor speed or a measured value derived from these.

BRIEF DESCRIPTION OF THE DRAWINGS

In the following the invention is further described with reference to an embodiment schematically shown in the drawing in which.

DETAILED DESCRIPTION OF THE INVENTION

Figure 1:
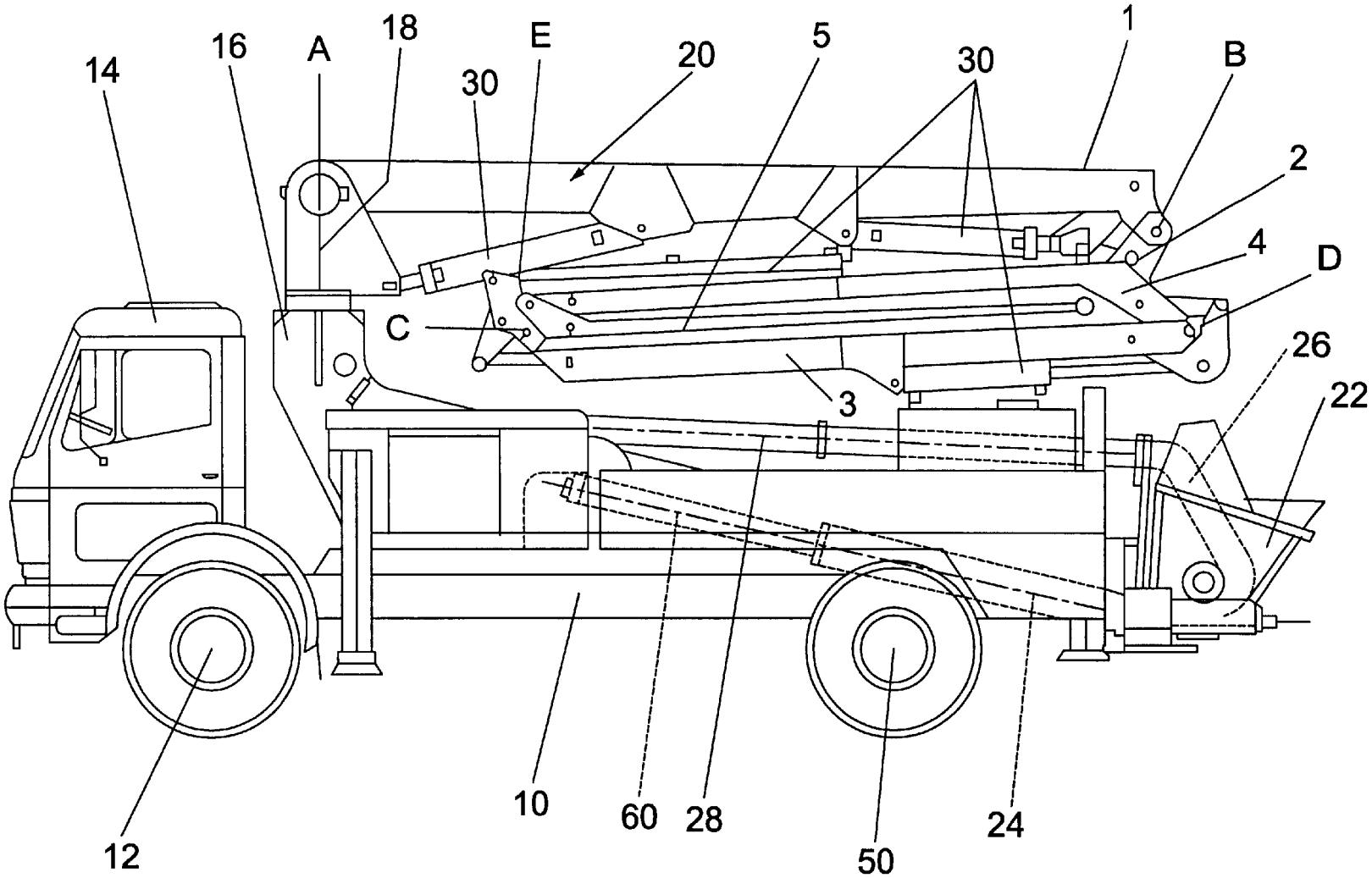
FIG. 1 shows a side view of a mobile concrete pump comprising a concrete distributer mast in its folded state.
Figure 2:
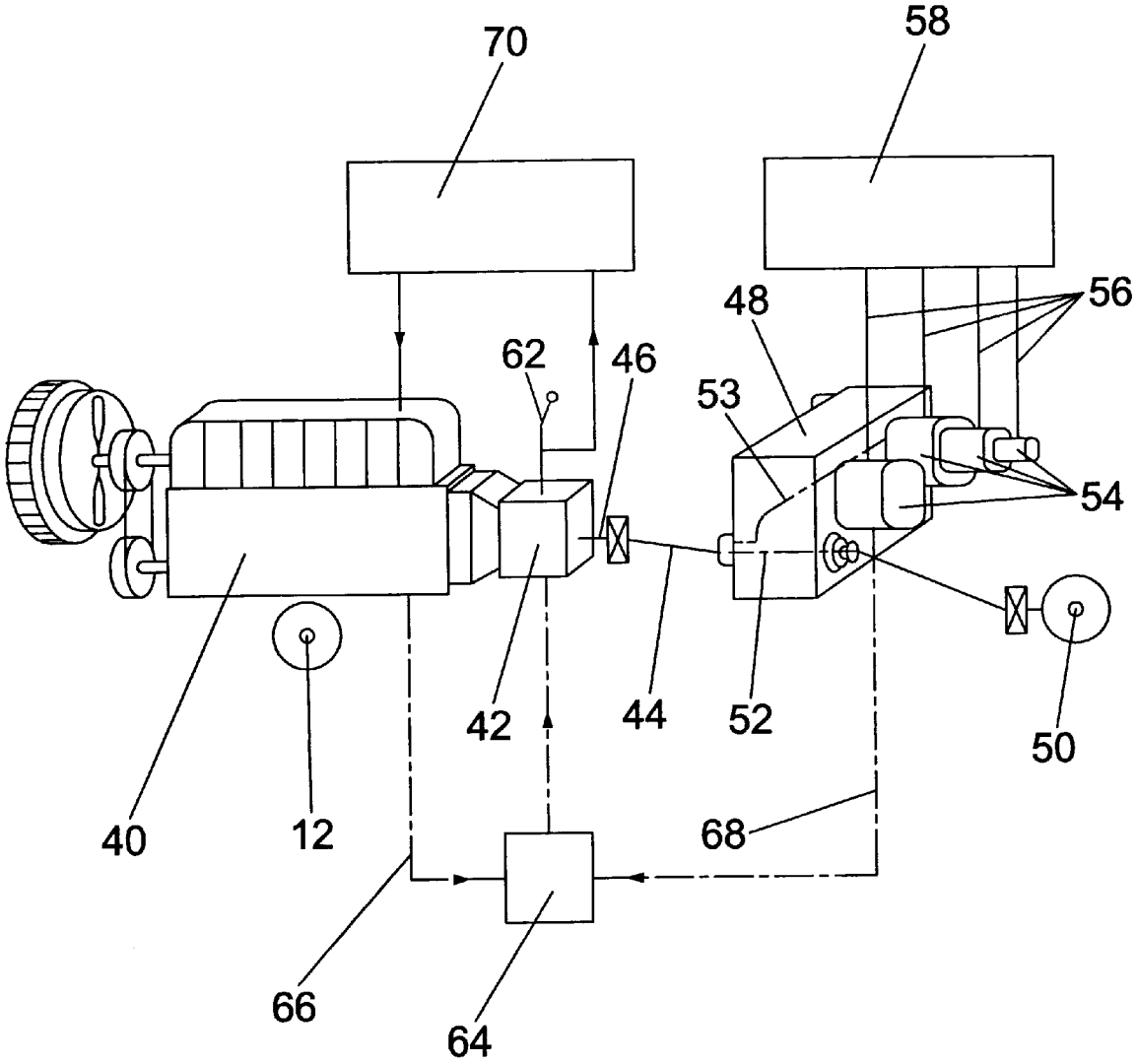
FIG. 2 shows a schematic of the driving and pumping mechanism of the mobile concrete pump of FIG. 1.

The mobile concrete pump shown in FIG. 1 comprises a chassis 10, a pivot bearing pedestal 16 disposed in the vicinity of the front axle 12 and the cabin 14 of the chassis 10, an articulated mast 20 which can be rotated on the pivot bearing pedastal 16 through 360° about a vertical axis 18, a hydraulically driven concrete pump 24 which can be subjected to concrete from a material feed container 22, and a transport conduit 28 which is coupled to the concrete pump 24 by way of a pipe shunt 26. The five mast arms 1, 2, 3, 4, and 5 of the articulated mast 20 are connected to the pivot bearing pedastal 16 at the pivot bearing A and to each other at the elbow joints B, C, D, and E. The folding and unfolding of the mast arms 1 to 5 about the joints A to E is effected hydraulically by means of double-acting hydraulic cylinders 30 which are connected at their free cylinder-side and rod-side ends to brackets of the mast arms 1 to 5 and of the pivot bearing pedastal 16.

The vehicle motor 40 which is disposed beneath the cabin 14 is intended to drive the vehicle as well as the concrete pump by way of the gear box 42. To this end a transfer gear box 48 is disposed in the region of the drive train, the input of which transfer gear box is connected to the driven shaft 46 of the gear box 42 and which can be alternatingly switched from a direct drive 52 leading to the rear axle 50 for the driving operation to a distributor group 53 which is connected to the hydraulic pumps 54 with a defined ratio. The hydraulic pumps 54 are connected to a hydraulic block 58 of the concrete pump 24 by way of hydraulic conduits 56, which hydraulic block 58 is connected to the hydraulic drive cylinders 60 and the switching cylinders (not shown in the drawing) for the pipe shunt 26.

The gear box 42 has two specific gear ratios for driving the hydraulic pumps 54 during the pumping operation, one of which is a direct ratio (i=1) and the other an overdrive having a speed increasing ratio (i<1). The switching is effected in the shown embodiment by way of a gear selector 62 or a control device 64. The control device 64 may be either a cable operated or a wireless remote control device which is, for instance, disposed in a remote operating device for the concrete pump. On the other hand, it may also be designed as an automatic switching unit which responds to, for instance, the motor speed picked up from the signal line 66 or the pump pressure picked up from the signal line 68 and which performs a switching operation when falling below or exceeding a preset threshold value. Furthermore, a mechanical or electronic speed limiter device 70 is provided, which sets different maximum motor speeds in dependence on the selector position of the gear box 42, for example picked up from the gear selector 62. With these measures it is achieved that the hydraulic pumps 54 are driven with always the same maximum pump speed by the transfer gear box 48, independent of the selected gear ratio. The higher maximum motor speed of for instance 1800 rpm in the direct ratio which is matched to the nominal speed of the vehicle motor 40 enables a higher power output, but it causes a higher noise level and increased fuel consumption. With the lower maximum motor speed of, for example, 1350 rpm in overdrive the noise level and fuel consumption is reduced at the cost of a lower power output. In both cases the hydraulic pumps 54 are driven at the same speed, so that an optimum pump operation is ensured. The operation in overdrive is to be considered especially when it is not necessary to make use of the full motor power and when a lower noise lever is desired, for instance during night time operation or at locations where low noise levels are mandated.

When the gear box 42 of the vehicle does not have an overdrive but only a direct ratio (i=1) and a speed reducing ratio (i>1), the transfer gear box 48 may be provided with a high ratio which is matched to the second fastest gear. By this the lower motor speed necessary to reduce the noise level and fuel consumption is obtained by shifting the gear box from the second fastest gear (i>1) to the fastest gear (i=1), wherein the second fastest gear of the gear box makes it possible to use the full power output of the motor at the nominal speed of the motor, while the motor speed in the fastest gear is limited to a value lower than the nominal speed.

A further possibility to operate the concrete pump with different motor speeds at a constant maximum pump output is also given when the hydraulic pump is driven by a switchable secondary driven unit of the gear box instead of by a transfer gear box. In this case the speed limitation as described above is matched to the ratios of the secondary driven unit.

In summary the following is to be stated: The invention is related to a mobile thick matter pump having a drive mechanism comprising a vehicle motor 40 and a gear box 42, at least one hydraulic pump 54 for driving the thick matter pump 24, which pump is adapted to be coupled to a driven shaft 46 of the gear box 42, if need be under interposition of a transfer gear box 48, as well as a speed limiter device 70 for setting a maximum motor speed during the operation of the pump. In order to ensure an optimum pumping operation also at lower noise levels, it is proposed according to the invention that the gear box 42 has at least two gear ratios, at the selection of which different maximum motor speeds are set by way of the speed limiter device 70.

What is claimed is:

1. A mobile thick matter pumping having:

a drive mechanism comprising a vehicle motor (40) and a gear box (42) connected to the vehicle motor (40), a drive shaft (46) connected to the gear box (42), at least one hydraulic pump (54) for driving the thick matter pump (24), which pump is adapted to be coupled to said drive shaft (46), optionally under interposition of a transfer gear box (48), as well as a speed limiter device (70) for setting a maximum motor speed during the operation of the pump, wherein the gear box (42) has at least first and second gear ratios, and wherein upon selection of said first gear ratio said speed limiter device limits said vehicle motor (40) to a first maximum motor speed, and upon selection of said second gear ratio said speed limiter device limits said vehicle motor (40) to a second maximum motor speed which is different from said first maximum motor speed.

2. The mobile thick matter pump of claim 1, wherein said first gear ratio is a direct ratio (i=1) and said second gear ratio is an overdrive ratio (i<1).

3. The mobile thick matter pump of claim 1, wherein the maximum motor speeds allocated to the different gear ratios are essentially proportional to the gear ratios, respectively.

4. The thick matter pump according to claim 1, further comprising a sensor for controlling the speed limiter device (70), which sensor senses the gear selector position of the gear box (42) and transmits this information to the speed limiter device.

5. The thick matter pump according to claim 1, further comprising a remote control device for sending remote control signals and a switching device (64) for receiving remote control signals from said remote control device and controlling the gear box (42) and thereby controlling the speed limiter device (70).

6. The thick matter pump according to claim 1, further comprising a switching device (64) for automatically changing the gear ratios in response to falling below or exceeding a present pump pressure.

7. The thick matter pump according to claim 1, further comprising a switching device for automatically changing the gear ratios, which switching device responds to falling below a predetermined minimum motor speed or exceeding a predetermined maximum motor speed.

8. The thick matter pump according to claim 1, wherein the speed limiter device (70) comprises an adjustable mechanical limit stop and an adjusting mechanism for controlling the fuel delivery to the vehicle motor.

9. The thick matter pump according to claim 1, wherein the speed limiter device (70) comprises a micro processor circuit for limiting the motor speed in dependence upon the chosen gear ratio.

* * * * *